United States Patent [19]

Towns et al.

[11] Patent Number: 4,685,580

[45] Date of Patent: Aug. 11, 1987

[54] ANTI-PANELLING CONTAINER CLOSURE

[75] Inventors: Edward J. Towns, Summit; Edward M. Brown, Livingston, both of N.J.

[73] Assignee: TBL Development Corporation, Livingston, N.J.

[21] Appl. No.: 853,769

[22] Filed: Apr. 18, 1986

[51] Int. Cl.[4] ..... B65D 51/16

[52] U.S. Cl. ..... 215/260

[58] Field of Search ..... 215/260, 307; 220/203, 220/209, 367

[56] References Cited

U.S. PATENT DOCUMENTS 3,114,467 12/1963 Montgomery ..... 215/260

4,036,386 7/1977 Nishioka et al. ..... 215/260

*Primary Examiner*—Donald F. Norton

*Attorney, Agent, or Firm*—Robin, Blecker & Daley

[57] ABSTRACT

A container closure member is adapted for receiving a container sealing liner, the closure member comprising a top panel and a skirt depending downwardly from the top panel. First projections depend downwardly from the top panel interiorly of the closure for defining, with the liner received in the closure member, a first air flow passage extending from beneath the top panel to the skirt. Second projections depend inwardly from the skirt interiorly of the closure for defining, with the liner received in the closure member, a second air flow passage extending downwardly along the skirt to ambient environment, the second air flow passage being in flow communication with the first air flow passage. The liner has container sealing surface at its periphery and a central air flow passage in communication with such first and second air flow passages.

17 Claims, 8 Drawing Figures

ANTI-PANELLING CONTAINER CLOSURE

FIELD OF THE INVENTION

This invention relates generally to container closures supporting internal airflow and relates more particularly to closures for averting panelling in containers closed thereby.

BACKGROUND OF THE INVENTION

So-called container "panelling" is a term of art meaning that the normally straight or flat sidewalls of a plastic fluid container are distorted inwardly, presenting an undesired appearance to a consumer and giving rise to consumer uncertainty as to content quality.

By way of an understanding of a cause of panelling, consider that a liquid container has part product content, e.g., a liquid, and part air content, i.e., volume of the container not occupied by the liquid product, or head air space. If, after sealed closing, the original air volume at container closure contracts in volume, it accordingly increases in vacuum pressure. Such increased vacuum pressure in the container can collapse sidewalls, i.e., the excessive pressure is not realizable without container volume decrease. Thus, there occurs panelling, container volume decrease and accommodation of pressure change.

Panelling is not a matter of concern where the container sidewalls are, by nature, tolerant of original air content volume contraction and vacuum pressure attending same. Thus, glass and metal containers generally are not susceptible to panelling and do not present the aforementioned consumer acceptance problems associated therewith. However, plastic containers in widespread use are susceptible to panelling and frequently evidence same. By way of example, assume automotive motor oil at an elevated temperature, substantially above ambient/environmental temperature, to be containerized at such elevated temperature. With a proper closure seal presumed, upon drop in temperature of the motor oil to ambient temperature, panelling occurs due to lessening of head space air volume and increased vacuum pressure attendant thereto. Accordingly, measures, costly and time-consuming, need be taken to avert such panelling. Typically, there is believed to be a forced cooling of the motor oil prior to containerization. Such anti-panelling measure is disadvantageous, both in terms of the cost of the practice, the inconvenience of container sealing at a time delayed from filling and attendant shipment delays. Panelling also limits the stack load possible due to unbalance bottle supportability caused by panelling.

SUMMARY OF THE INVENTION

The present invention has as its primary object the provision of closures having anti-panelling characteristics.

A complemental object of the invention is to provide closed containers exhibiting anti-panelling characteristics.

A further object of the invention is to provide improved and simplified closures supporting internal airflow for anti-panelling or other venting purposes and closure members therefor.

In attaining these and other objects, the invention provides a container closure member adapted for receiving a container sealing liner, the closure member comprising a top panel and a skirt depending downwardly from the top panel. First projection means depend downwardly from the top panel interiorly of the closure for defining, with the liner received in the closure member, a first air flow passage extending from beneath the top panel to the skirt. Second projection means depend inwardly from the skirt interiorly of the closure for defining, with the liner received in the closure member, a second air flow passage extending downwardly along the skirt to ambient environment, the second air flow passage being in flow communication with the first air flow passage.

In its particularly preferred closure member embodiment, the invention provides that the first projection means comprises a plurality of individual projections each having first ends adjacent the skirt and second ends at locations spaced from the center of the top panel. The second projection means comprises a plurality of individual projections in common number with the projections of the first projection means and having first ends juxtaposed respectively with the first ends of the projections of the first projection means. The skirt includes interior threading spaced from the top panel, and the projections of the second projection means have second ends adjacent the skirt threading.

The invention further provides a container closure comprising a closure member having a top panel and a skirt depending downwardly from the top panel and a container sealing liner retentively disposed in the closure member in facing relation to the top panel, the liner having peripheral extent adapted to effect such container sealing and central extent interiorly of the peripheral extent for providing air flow through the liner. The closure member has first projection means depending downwardly from the top panel interiorly of the closure for defining with the liner a first air flow passage extending from beneath the top panel and beyond the liner to the skirt, and second projection means depending inwardly from the skirt interiorly of the closure for defining with the liner a second air flow passage extending downwardly along the skirt and outwardly of the liner, the second air flow passage being in flow communication with the first air flow passage.

In its particularly preferred anti-panelling closure embodiment, the invention provides that the top panel and the liner jointly define valve means for selectively effecting air flow through the liner. The valve means comprises an opening extending through the liner and a member depending from the top panel and adapted for sealing residence in the liner opening. The liner includes a hinge section interiorly successive to the peripheral extent thereof and flexible diaphragm interiorly successive to the hinge section, the hinge section and flexible diaphragm supporting the liner central extent for displacement substantially parallel to the top panel.

The liner opening desirably comprises an aperture of first diameter in facing relation to the top panel and an inwardly tapered passage extending downwardly from the aperture to a passage of second diameter less than the diameter. The top panel member has frustro-conical configuration, the larger diameter of which exceeds such first diameter and the lesser diameter of which is less than such first diameter.

The invention contemplates usage of the closure member thereof for container venting purposes other than anti-panelling purpose, as is noted below.

The foregoing and other objects and features of the invention will be further understood from the following detailed description of preferred embodiments thereof and from the drawings wherein like reference numerals identify like parts and components throughout.

DESCRIPTION OF THE PREFERRED EMBODIMENTS

Figure 1:
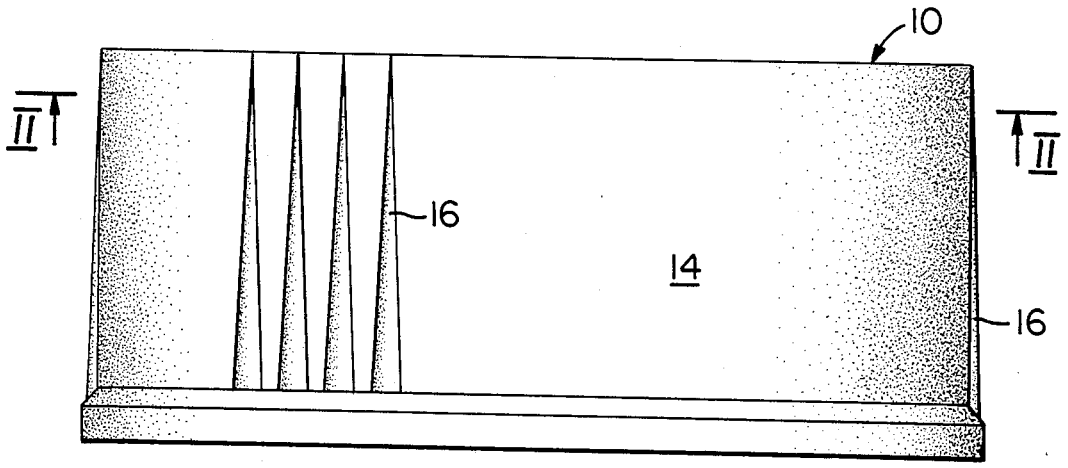
FIG. 1 is a front elevational view of a closure member of a container closure in accordance with the invention.
Figure 2:
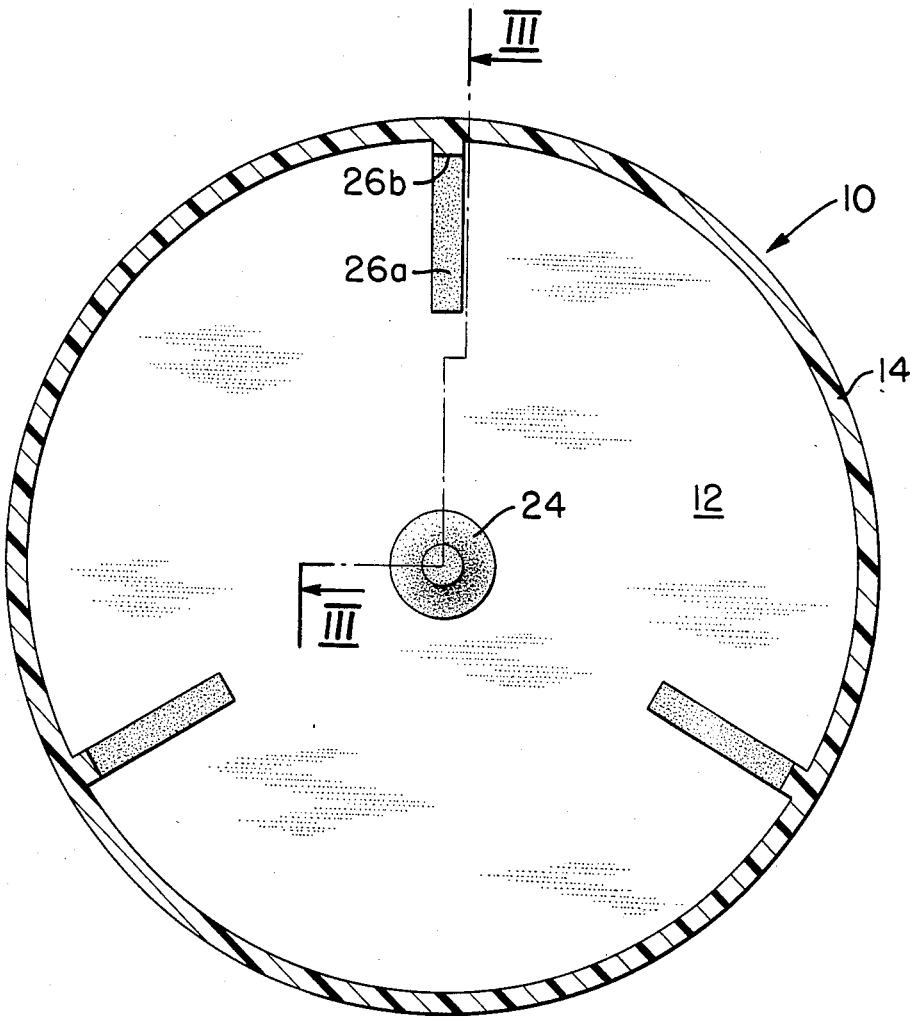
FIG. 2 is a sectional view of the FIG. 1 closure member as would be seen from plane II—II of FIG. 1.
Figure 3:
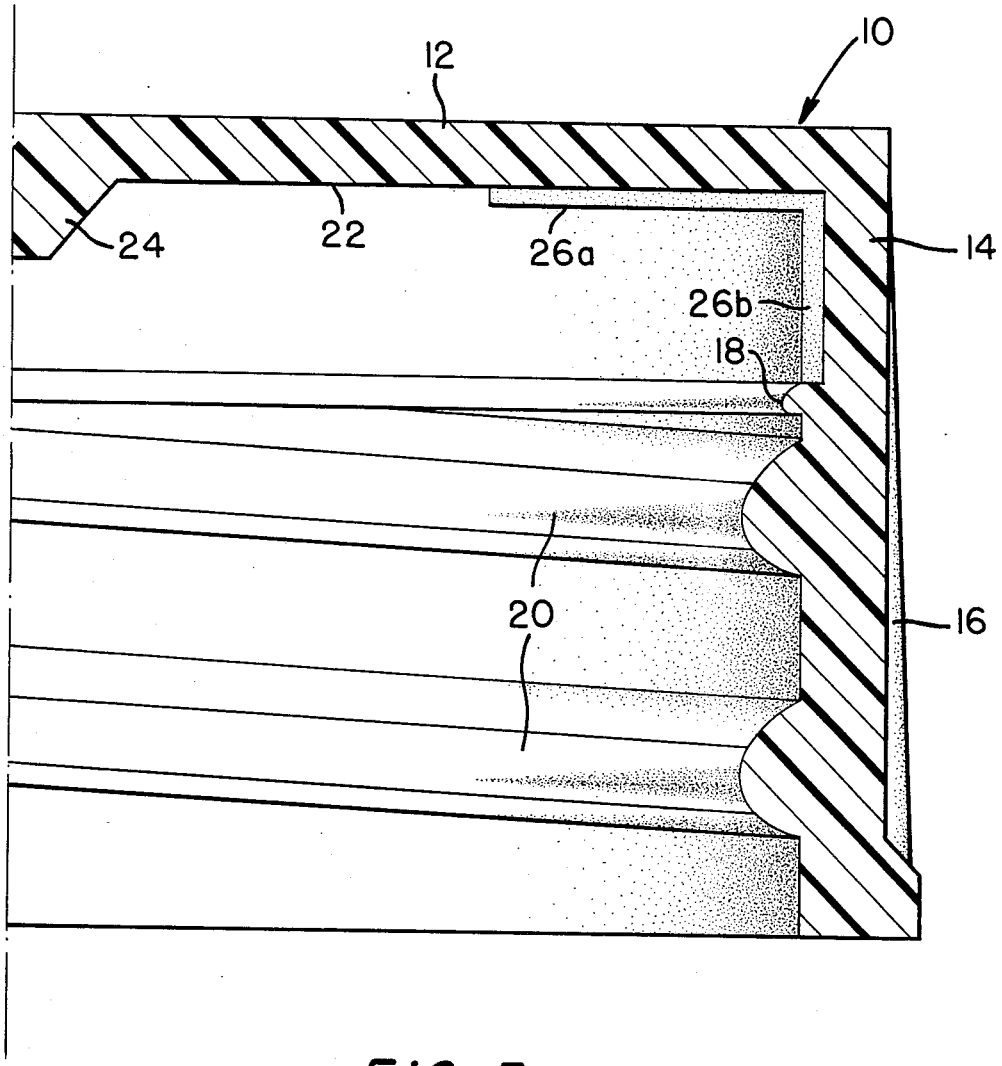
FIG. 3 is a sectional view of one-half of the FIG. 1 closure member as would be seen inverted from viewing plane III—III of FIG. 2.

Referring to FIGS. 1, 2 and 3, closure member or cap 10 of a container closure of the invention is formed throughout of rigid plastic or other material by molding practice, to provide a unitary structure. Top panel 12 is circular in outline and has skirt 14 depending therefrom. At its exterior, closure member 10 may include gripping protrusions 16 and it is interiorly beaded at 18 and threaded at 20. Undersurface 22 of top panel 12 has a frustro-conical member 24 extending centrally downwardly therefrom in instances wherein closure member 10 need provide valve action cooperatively with a liner, e.g., for anti-panelling purposes, below discussed.

Top panel projections or ribs **26*a* preferably are three in number and are spaced mutually equiangularly in the illustrated embodiment. They extend outwardly of top panel undersurface 22, interiorly of the closure and extend from first ends adjacent skirt 14 radially inwardly to second ends at locations spaced from the center of top panel 12 and its member 24. Ribs 26*b* extend from first ends adjacent top panel 12 axially downwardly, inwardly of skirt 14, to second end locations adjacent circumferential bead 18 and threads 20. In the depicted embodiment, ribs 26*b* are continuous and integral with ribs 26*a*** and in mutual alignment therewith, but may be arranged otherwise, as noted below.

Figure 4:
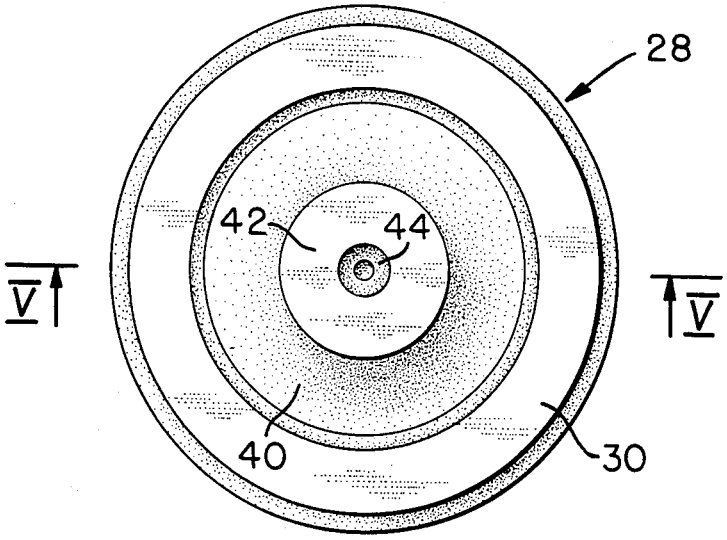
FIG. 4 is a top plan view of a liner for use with the FIG. 1 closure member to provide an anti-panelling closure.
Figure 5:
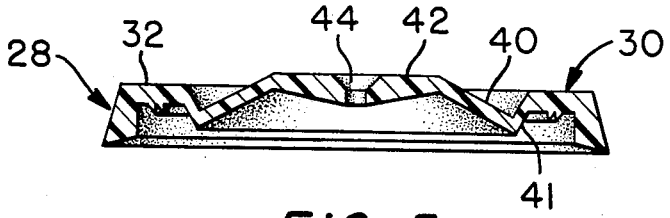
FIG. 5 is central sectional view of the FIG. 4 liner as would be seen from plane V—V of FIG. 4.
Figure 6:
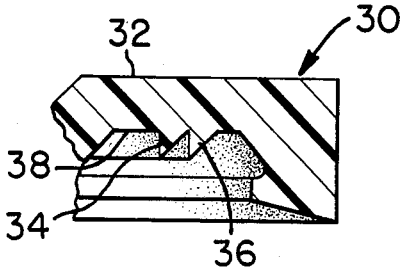
FIG. 6 is an enlarged sectional view of the peripheral portion of the FIG. 4 liner, showing sealing cone detail.

Turning to FIGS. 4, 5 and 6 and the anti-panelling practice of the invention, liner 28, formed of plastic and of material more resilient than the material comprising closure member 10, has a peripheral portion 30 with flat upper surface 32. Sealing members 34 and 36 (FIG. 6) in the form of radially inwardly converging cones, may project from undersurface 38 and are adapted to continuously sealingly engage the neck of a container throughout the course of anti-panelling liner and closure member activity providing selective air flow into the container.

A frustro-conical liner flexible diaphragm portion 40 is supported by liner peripheral portion 30 through liner hinge section 41 and extends radially interiorly thereof, preferably being contiguous therewith, as by being unitarily molded with portion 30 and section 41.

Liner diaphragm portion 40 supports liner central extent 42, having opening 44 extending fully therethrough. The liner opening 44 desirably comprises an aperture of first diameter in facing relation to the top panel and an inwardly tapered passage extending downwardly from the aperture to a passage of second diameter less than the first diameter.

Top panel member 24 (FIGS. 3, 7 and 8) desirably has frustro-conical configuration, the larger diameter of which, i.e., at top panel undersurface 22, exceeds such liner opening first diameter and the lesser diameter of which i.e., that remotely disposed from surface 22, is less than such first diameter. Further, top panel member 24 extends outwardly downwardly of surface 22 in excess of the extent of ribs **26*a* therefrom. These parameter selections assure consistent operation of the valve formed by the closure member and liner. Further, the liner central portion is of thickness substantially in excess of that of the liner diaphragm portion and its hinge section, akin to that of the liner peripheral portions, such that valve action will be enhanced further by generally parallel movement of the liner central portion away from and relative to the top panel, as noted in connection with FIG. 8** below.

Figure 7:
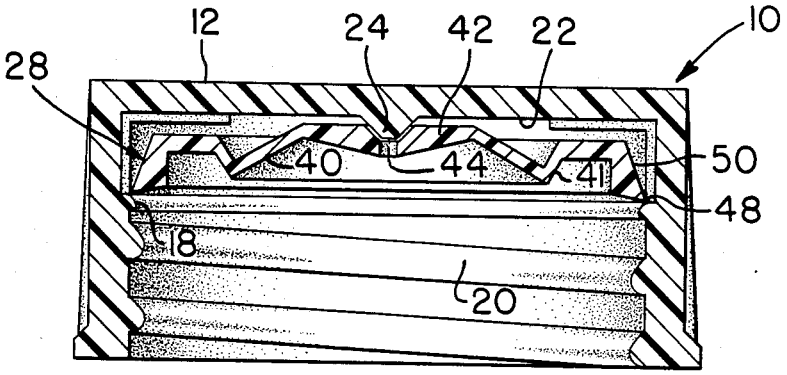
FIG. 7 is a central sectional view of the closure member of FIGS. 1–3 and the liner of FIGS. 4–6 assembled, but not applied to a container.

To assemble closure member and liner 28, the latter is placed in the lower open end of the former and pressed therein to the liner retention position shown in FIG. 7. Here, lower edge 48 of liner 28 is in axial interference with bead 18, effecting such liner retention. In the course of arrival at such position, sidewall 50 engages threads 20 and then bead 18 is resiliently deflected radially inwardly to ride over the threads and bead and then flexes back to it normal shape illustrated in FIG. 7.

Figure 8:
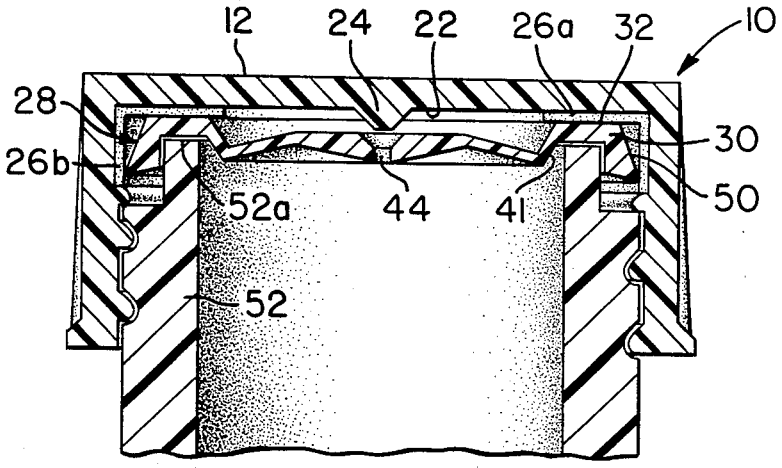
FIG. 8 is a central sectional view of the closure member of FIGS. 1–3 and the liner of FIGS. 1–3 and the liner of FIGS. 4–6 assembled and applied to a container, conditions being shown for operation of the closure valve to admit ambient air to the container to avert panelling.

In FIG. 8, liner 28 is shown in sealed relation to top surface **52*a* of container neck 52. As is seen also, liner peripheral portion 30 has its upper surface 32 in compressed abutment with closure member ribs 26*a* and its sideward surface 50 in abutment with closure member ribs 26*b*. The liner material is more compressible than that of the closure member and the ribs may accordingly enter and form radial and axial depressions in surfaces 32 and 50, respectively, depending upon the torque applied in container closing. There are formed, nonetheless, based on the absence of sealing associated with such depressions, a plurality of closure flow paths, first (1) radially above and/or through such depression formed by ribs 26*a* in surface 32, and second (2) axially downwardly, along skirt 14, through the interspaces formed by ribs 26*b* in surface 50. A third flow path (3) extends axially past bead 18** and through the closure and container threads, which are also not in airtight relationship.

In FIG. 8, vacuum pressure exists in the sealed container such that diaphragm 40 is drawn downwardly, hinge section 41 walls rotating radially outwardly in accommodating such diaphragm downward movement, such that liner central extent 42 moves substantially in parallelism with top panel undersurface 22. This places flow passage 44 of liner central extent 42 in flow communication with the above noted flow paths (1)–(3). As is shown, clearance now exists between plug valve member 24 and liner opening 44. On this event, air ambient to closure member 10, i.e., atmospheric air, is admitted into the container through flow passage 44, thereby increasing contained air volume and effecting a lessening of vacuum pressure therein. As vacuum pressure internal to the container lessens, it reaches a level incapable of downwardly deflecting diaphragm portion 40 and, rather, positively urges same into its disposition providing a sealed relation between plug member 24 and liner passage 44.

By way of example of the invention, in anti-panelling aspect, motor oil or other fluids at elevated temperature, e.g., above one hundred and eighty degrees as available at the point of manufacture, is immediately applied as fill for a container. The container, with some air content above the oil, is thereupon sealingly closed by a closure of the invention as heretofore discussed and described, and is placed in ambient environment for shipping purposes. Thus, no chilling or other forced cooling intervenes the filling and container closing events. It is found that container sidewall panelling, otherwise occuring in practice outside the invention, does not occur by reason of pressure-induced operation of the valve of the closure of the invention, selectively as need during fall in temperature of the liquid.

As noted above, the closure member of the invention would be usable in other than anti-panelling applications. Thus, applications are to be noted wherein so-called "breathable" liners are employed to permit excessive container internal positive pressurization to be relieved. The art has seen TYVEC (a product of du-Pont) and GORTEK (a product of W. L. Gore), both materials adapted to breath excessive container internal positive pressure therethrough. Such materials may be directly usable with the closure member, having internal flow capacity, above discussed.

Various changes to and modifications of the particularly described and depicted closure embodiment and closure member may be made without departing from the invention. For example, the valve obtainable from the closure member and liner may be reversely configured, e.g., top panel member 24 may be configured, rather than as a plug member effecting residence in the liner central portion opening, as a valve seat adapted to selectively close such liner opening. Likewise, the dependent container sealing by the liner may be otherwise configured from that above discussed, e.g., with one flexible cone, rather than two, or other sealing surfaces engaging the container neck. As alluded to, ribs 26*a* may be other than integrally formed in alignment with ribs 26*b*. Their functions, to provide the flow paths to the liner opening and ambient may thus be realized by other than liner and closure structure defining flow paths (1) and (2) above noted. Further, while non-air-tight engagement threading provides flow path (3) above, non-threaded engagement will function similarly. Accordingly, the particularly described and depicted embodiments are intended in an illustrative and not in a limiting sense. The true spirit and scope of the invention is set forth in the following claims.

We claim:

1. A container closure member adapted for receiving a container sealing liner, said closure member comprising a top panel and a skirt depending downwardly from said top panel, first projection means depending downwardly from said top panel interiorly of said closure for defining, with said liner received in said closure member, a first air flow passage extending from beneath said top panel to said skirt, and second projection means depending inwardly from said skirt interiorly of said closure for defining, with said liner received in said closure member, a second air flow passage extending downwardly along said skirt, said second air flow passage being in flow communication with said first air flow passage.

2. The invention claimed in claim 1 wherein said first projection means comprises a plurality of individual projections each having first ends adjacent said skirt and second ends at locations spaced from the center of said top panel.

3. The invention claimed in claim 2 wherein said second projection means comprises a plurality of individual projections in common number with said projections of said first projection means and having first ends juxtaposed respectively with said first ends of said projections of said first projection means.

4. The invention claimed in claim 3 wherein said skirt includes interior threading spaced from said top panel, said projections of said second projection means having second ends adjacent said skirt threading.

5. The invention claimed in claim 3 wherein corresponding ones of said projections of said first and second projection means are in mutual alignment.

6. The invention claimed in claim 1 wherein said top panel further includes a member depending centrally downwardly therefrom interiorly of said closure member, said first projections means being in non-interfering disposition with respect to said top panel member.

7. The invention claimed in claim 6 wherein said top panel member extends downwardly interiorly of said closure member to an extent exceeding the downwardly extending interior extent of said first projection means.

8. The invention claimed in claim 7 wherein said top panel is circular in configuration, wherein said top panel member is frustro-conical in configuration and wherein said first projection means extends radially of said top panel.

9. The invention claimed in claim 8 wherein said first projection means comprises a plurality of individual projections each having first ends adjacent said skirt and second ends at locations spaced from said top panel member.

10. The invention claimed in claim 9 wherein said second projection means comprises a plurality of individual projections in common number with said projections of said first projection means and having first ends juxtaposed respectively with said first ends of said projections of said first projection means.

11. The invention claimed in claim 10 wherein said skirt includes interior threading spaced from said top panel, said projections of said second projection means having second ends adjacent said skirt threading.

12. The invention claimed in claim 10 wherein corresponding ones of said projections of said first and second projection means are in mutual alignment.

13. A container closure comprising a closure member comprising a top panel and a skirt depending downwardly from said top panel and a container sealing liner retentively disposed in said closure member in facing relation to said top panel, said liner having peripheral extent adapted to effect such container sealing and central extent interiorly of said peripheral extent for providing air flow through said liner, said closure member having first projection means depending downwardly from said top panel interiorly of said closure for defining with said liner a first air flow passage extending from beneath said top panel and beyond said liner to said skirt, and second projection means depending inwardly from said skirt interiorly of said closure for defining with said liner a second air flow passage extending downwardly along said skirt and outwardly of said liner, said second air flow passage being in flow communication with said first air flow passage.

14. The invention claimed in claim 13 wherein said top panel and said liner jointly define valve means for selectively effecting air flow through said liner.

15. The invention claimed in claim 14 wherein said valve means comprises an opening extending through said liner central extent and a member depending from said top panel and adapted for sealing residence in said liner opening.

16. The invention claimed in claim 15 wherein said liner includes a hinge section interiorly successive to said peripheral extent thereof and a flexible diaphragm interiorly successive to said hinge section, said flexible diaphragm supporting said liner central extent for displacement substantially parallel to said top panel.

17. The invention claimed in claim 16 wherein said liner opening comprises an aperture of first diameter in facing relation to said top panel and an inwardly tapered passage extending downwardly from said aperture to a passage of second diameter less than said first diameter, said top panel member being in frustro-conical configuration the larger diameter of which exceeds said first diameter and the lesser diameter of which is less than said first diameter.

* * * * *